US006336559B1

(12) United States Patent
Knoll et al.

(10) Patent No.: US 6,336,559 B1
(45) Date of Patent: Jan. 8, 2002

(54) SPIRAL SEPARATOR WITH REPLACEABLE TROUGH SECTIONS

(75) Inventors: Frank S. Knoll; Weng S. Kow, both of Jacksonville; Timo U. Niitti, Ponte Vedra, all of FL (US)

(73) Assignee: Outokumpu Oyj, Espoo (FI)

( * ) Notice: Subject to any disclaimer, the term of this patent is extended or adjusted under 35 U.S.C. 154(b) by 0 days.

(21) Appl. No.: 09/449,381

(22) Filed: Nov. 24, 1999

(51) Int. Cl.[7] ..... B03B 5/52; B03B 5/24
(52) U.S. Cl. ..... 209/459; 209/458; 209/506
(58) Field of Search ..... 209/458, 459, 209/506

(56) References Cited

U.S. PATENT DOCUMENTS 1,197,056 A * 9/1916 Pardee
1,454,904 A * 5/1923 Pardee
1,515,965 A * 11/1924 Pardee
5,184,731 A * 2/1993 Robertson et al. ..... 209/459
5,452,805 A * 9/1995 Robertson et al. ..... 209/697

* cited by examiner

*Primary Examiner*—Donald P. Walsh
*Assistant Examiner*—Jonathan R. Miller
(74) *Attorney, Agent, or Firm*—Arthur G. Yeager

(57) ABSTRACT

Replaceable inserts are provided in depressions of a spiral separator wherein the inserts have surface irregularities to optimize the spiral efficiencies in separating feed stock materials. These irregularities become worn by the materials and would require replacement of the spiral, ordinarily, whereas new inserts herein greatly extend the useful life of the spiral. Also, if the feed of the spiral changes appropriate new inserts may be used to separate the changed feed. The inserts may be any shape, circular being preferred when adjustability is needed.

20 Claims, 4 Drawing Sheets

SPIRAL SEPARATOR WITH REPLACEABLE TROUGH SECTIONS

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Field of the Invention

This invention relates to the field of spiral separators; and more particularly, to such separators with replaceable trough inserts or sections.

2. Description of the Related Art

The prior art to this invention includes spiral separators employed to separate mixtures of particulate materials into their component parts. Minerals of different densities are frequently separated by passing a liquid slurry of the mineral mixture through such a separator and allowing the more dense mineral to move by centrifugal forces created in the spiral flow of the slurry to an outflow where a splitter makes a final separation between two types of materials. When spirals are provided with spaced textured surfaces to improve spiral performance, these surfaces wear more than the remainder of the spiral due to friction which decreases the performance and eventually require replacement of the entire spiral. This is quite costly and there is a need for a better solution to extend the useful life of the spiral.

Among the many prior art patents are: U.S. Pat. No. 5,184,731 to Robertson et al, which describes and claims a spiral trough separator having protuberances in the trough to agitate ore particles and provide an increased separation of particles; and U.S. Pat. No. 5,452,805 to Robertson et al, which describes and claims a spiral separator having spaced groups of parallel grooves leading to spaced drains in the trough to provide an improved separation of particles in the feed.

BRIEF SUMMARY OF THE INVENTION

This invention provides for alteration of the separation characteristics of a spiral separator by providing a separator that has replaceable inserts or sections of the trough; the replacement inserts including different types, sizes, or distributions of flow deflectors that are capable of altering the flow directions of different materials as they are pushed along by the gravitational liquid flow. Preferably, the replacement sections are small enough and made with sufficient precision that the section can be pressed into place without the assistance of fasteners, etc. but they may be used, if desired. The flow deflectors that may be used on such replacement sections includes all the known types of small obstructions to smooth flow, including, but not limited to, abrasive studded surface, grooves, protuberance of any shape, hillocks, riffles, ridges, steps, valleys, etc. The shape of the replacement section is not critical although rectangular or angular shapes are preferred since there would be no tendency to rotate and while a circular shape is preferred when it is desired to have the capability of adjusting the direction of flow in the trough of the separator. Any replacement section may be permanently fastened to the trough of the separator once it has been adjusted to its most productive flow direction. However, the principal advantages of this invention are to readily change the separation characteristics of the separator in a way that is not permanent and is ready for another quick change and when the obstructions wear, thereby decreasing efficiency, i.e., the sections may be replaced at a tremendous savings to the users on an order of magnitude ten to twenty over replacement of the entire spiral thereby extending the useful life of the spiral. The properties of the spiral can be adjusted and optimized by turning the circular insert, e.g., in the event the feed material is changed.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
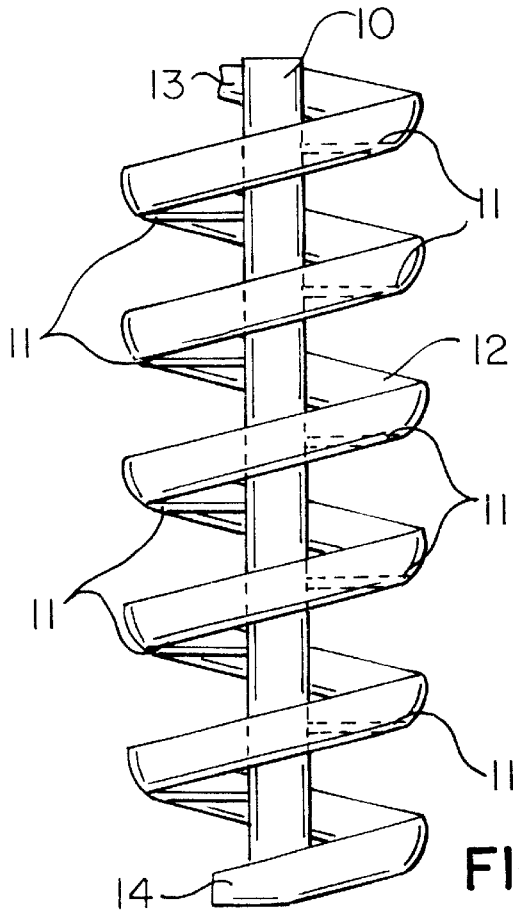
FIG. 1 is a front elevational view of a spiral conveyor separator in accord with the present invention.

A typical spiral conveyor is shown in FIG. 1 including an axial support column 10 and support arms 11 both of which may be built of any material so long as they support the spiral trough 12 which is endless between the entranceway 13 and the exitway 14. Generally, the support column 10 may be of metal, such as aluminum or stainless steel. The spiral trough 12 is of fiberglass, or other materials if the situation demands it. In the case of a separator, which is the principal use to which this invention is directed, there is also an adjustable splitter 14A located at the exitway 14 to permanently divide the two products that have been separated from each other as they have traveled down the trough 12 of the spiral conveyor. The purpose of the spiral is to feed a mixture of particulate minerals into the trough at entranceway 13 and to recover from exitway 14 particles of one type near the outside circumference of the trough 12. It is not necessary that the two types of particles be separated as far apart as the complete width of the trough 12, it is only necessary that the separation be such that a knife edge of the splitter 14A can be appropriately positioned to divide particles of one type from particles of the other type. Splitters can also be positioned at locations along the trough 12 to remove separated material, as known in the art.

Figure 2:
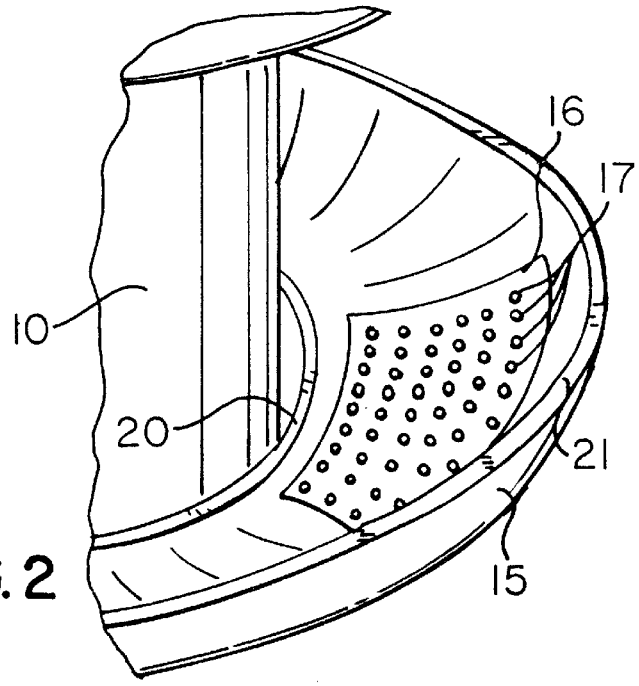
FIG. 2 is a perspective view of one flight or turn in the conveyor-separator of FIG. 1 wherein the trough of the conveyor-separator has been modified by introducing a plurality of protuberances in the path of the liquid and particles flowing down the spiral.
Figure 3:
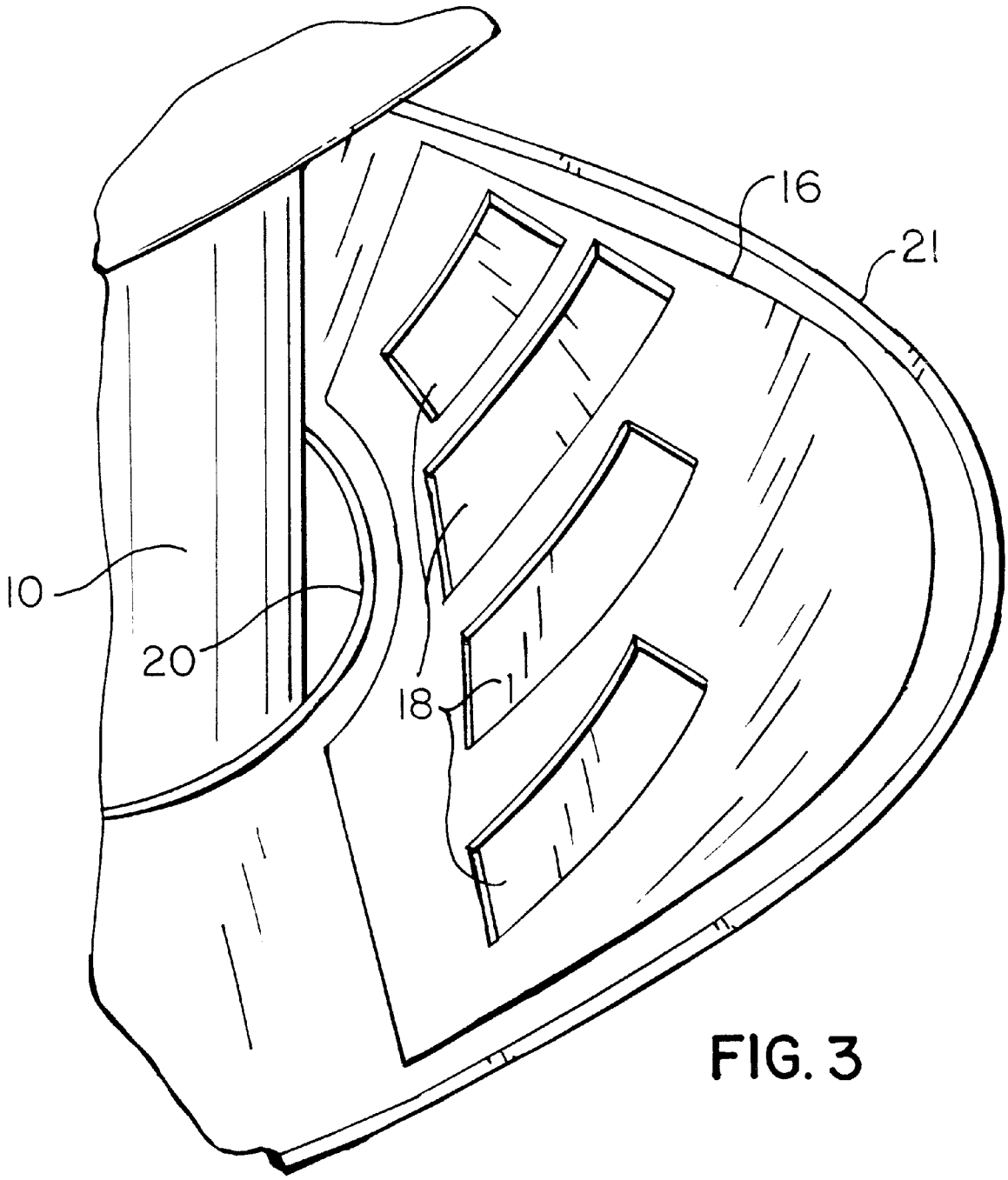
FIG. 3 is a perspective view of the same portion of the conveyor-separator as shown in FIG. 2, but altered in its flow characteristics by replacing the portion of the trough shown in FIG. 2 with a different section having a different set of flow deflectors; namely, four parallel, wide grooves.

In FIG. 2 there is shown a replacement section 16 having small bumps or protuberances 17 arranged in whatever pattern the owner chooses that is known to assist in affecting the separation of particles as they flow down the trough 15 of the separator. The section 16 is shaped like the inside of trough 15 and is fastened in place in any way suitable; preferably in a noninvasive way so that the trough 12 is not weakened or the smooth flow of liquid is not disrupted by any seams (ridges or grooves) between the insert or section 16 and the depression 24 formed in the trough 15. Also, section 16 should be secure in its seat in the depression 24 so that it will not easily be dislodged.

Figure 4:
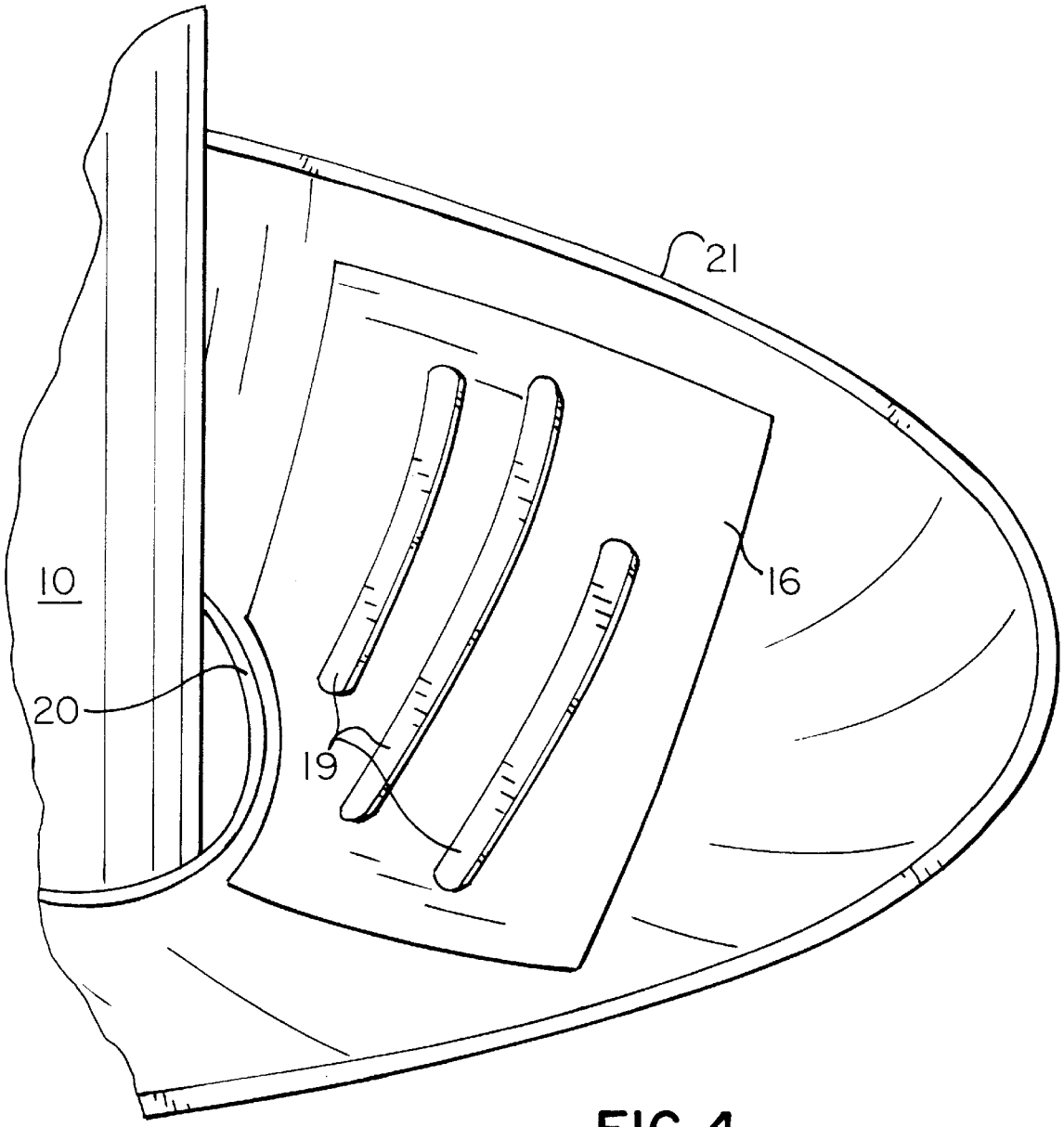
FIG. 4 is a perspective view similar to that of FIG. 3, except that the replacement section of the trough is a smaller section and it introduces three parallel, upstanding ridges as flow deflectors.

FIG. 4 illustrates another alternative design of flow deflector that may be used with the spiral separator of this invention. In this case the individual deflector is a raised bead or rib of material located so as to lie with its lengthwise dimension across the flow line of the liquid slurry of particles. Again design and testing determines the most productive position for the deflectors and, if time permits, the size and shape of the most productive deflector for the flowing mixture of particles that are to be separated.

Figure 5:
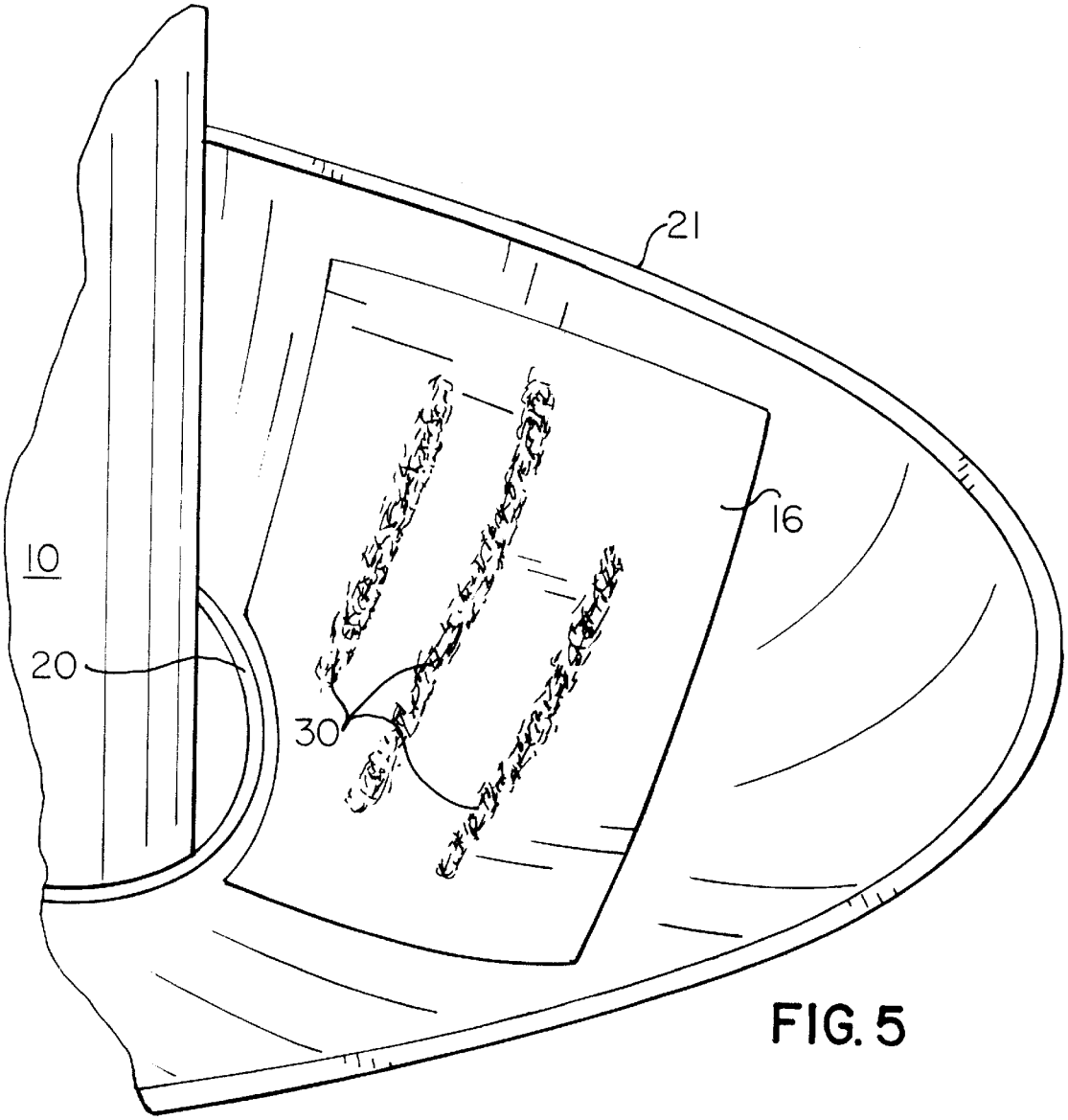
FIG. 5 is a perspective view similar to that of FIG. 4 and showing abrasive studded surface areas as flow deflectors.

FIG. 5 depicts a plurality of spaced abrasive or grit studded surface areas 20 on the surface of replacement section 16 of the spiral and act to deflect the flow of the solid particles in the slurry and/or impede the flow of solid particles and/or enhancing the separation thereof.

Figure 6:
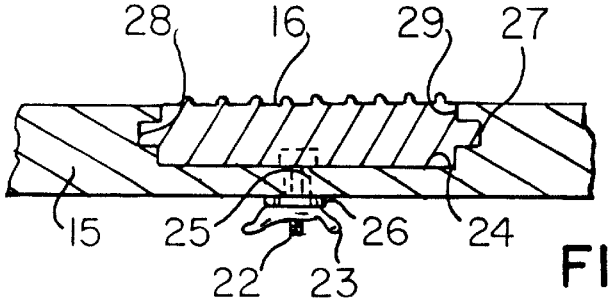
FIG. 6 is a cross-section through a replacement section of any acceptable type that is fastened to the trough by a bolt and a wingnut.

FIG. 6 shows an arrangement of fastening that is easy to manipulate and can be accomplished quickly by having a depression 24 conforming in size to section 16 in the trough 12 into which the replacement section 16 is tightly inserted or snapped. Section 16 may be provided with a reduced lip or flange 27 extending about its border which correspondingly fits within a groove or fold 28 in the side wall 29 defining depression 24. The flange 27 need not be continuous but may be formed by a plurality of spaced tabs or the like with a plurality of corresponding slots defining groove 28. FIG. 5 illustrates another fastening arrangement for replacement section 16 to trough 15 by a simple bolt 22 that has its head welded or embedded in the section 16 or fastened to replacement section 16, passed through a hole 25 in the depression 24 of trough 15 and a washer seal 26 placed on the bolt 22 outwardly of trough 15 and a wing nut 23 tightened to maintain section 25 in place and the hole sealed against leakage. The particular attachment, with or without 27 and 28, shown in FIG. 6 is especially adapted when the insert or section 16 is round and small to be substantially planar so that section 16 may be angularly adjusted to provide different flow characteristics.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what it is desirous to secure by Letters Patent of the United States is:

1. In a vertical axis spiral separator having a trough adapted to receive and conduct by gravity in a downward helical path a slurry of solid particles in a liquid carrier to an end location where a stream of solid particles is separated from a stream of said liquid and a light fraction of said particles; the improvement comprising a plurality of replaceable inserts vertically spaced along said trough, said trough having a plurality of spaced depressions for changing the surface profile of said trough at selected locations, along said trough inside concave surface, said replacement inserts having an upper surface with the same concavity and being flush adjoining with said trough inside concave surface, said inserts including surface irregularities that will disrupt the smooth flow of liquid and particles approaching said insert thereby enhancing separating characteristics of said spiral separator.

2. In the separator of claim 1 wherein said inserts have surface irregularities in the form of spaced knobs having a generally hemispherical surface projecting upwardly from said upper surface of said trough.

3. In the separator of claim 1 wherein said inserts have surface irregularities in the form of a spaced plurality of broad parallel grooves positioned at an acute angle to the direction of liquid flow in said trough.

4. In the separator of claim 1 wherein said inserts have surface irregularities in the form of a plurality of narrow parallel ribs projecting upwardly above said concave surface of said trough and positioned at an acute angle to a direction of liquid flow in said trough.

5. In the separator of claim 1 wherein said insert and said trough include a respective outer convex surface, a bolt projecting outwardly from said convex surface of said insert and adapted to fasten said insert to said trough through a hole in said trough.

6. In the separator of claim 1 wherein said insert includes an edge surface having a plurality of flanges that correspondingly fit into grooves in side walls defining said depression of said trough such that said insert lies flat against said trough with said upper surface of said insert and said inside surface of said trough are substantially congruent and coextensive with substantially unimpeded liquid flow caused by such fit.

7. In the separator of claim 1 wherein each said insert tightly nests within respective said depression, each said insert having a lower surface and a border edge between said lower and upper surfaces.

8. In the separator of claim 7 wherein each said insert and said depression include complemental flange and groove connections to positively lock each said flange into respective said groove.

9. In the separator of claim 8 wherein said groove is located in said depression and said flange is integral with said insert.

10. In the separator of claim 1 wherein said surface irregularities are in the form of abrasive materials projecting above said upper surface.

11. In the separator of claim 10 wherein said abrasive materials are located in spaced generally parallel elongated areas positioned at an acute angle to the direction of liquid flow in said trough.

12. In the separator of claim 5 wherein said insert is circular to permit selective rotation thereof to adjust the flow characteristics of said separator.

13. In a vertical axis spiral separator having a trough adapted to receive and conduct by gravity in a downward helical path a slurry of solid particles in a liquid carrier to an end location where a stream of said liquid and a heavy fraction of said particles is separated from a stream of said liquid and a light fraction of said particles; the improvement comprising at least one replaceable insert located in said trough, said trough having at least one depression for complementally receiving said insert, said insert having an upper surface for changing the surface profile of said trough located in at least one selected location, a replacement section for an inside concave surface of said trough, said replacement insert having the same concavity as that of the adjoining said inside surface of said trough, said insert including surface irregularities that will disrupt the smooth flow of liquid and particles approaching said insert thereby enhancing the separating characteristics of said spiral conveyor.

14. In the separator of claim 13 wherein said surface irregularities are in the form of spaced knobs having a generally hemispherical surface projecting upwardly from said concave surface of said trough.

15. In the separator of claim 13 wherein said surface irregularities are in the form of a plurality of broad parallel spaced grooves positioned at an acute angle to the direction of liquid flow in said trough.

16. In the separator of claim 13 wherein said surface irregularities are in the form of a plurality of narrow parallel spaced ribs projecting upwardly from said insert and positioned at an acute angle to a direction of liquid flow in said trough.

17. In the separator of claim 13 wherein said insert includes a bolt projecting outwardly and passing through a hole in said depression and through said trough, a seal and a nut on said bolt for tightly fastening and sealing said insert to said trough.

18. In the separator of claim 17 wherein said insert is circular to permit selective rotation thereof, said nut being tightened to fix said insert in its selective position.

19. In the separator of claim 13 wherein said insert includes at least one flange that fits into at least one groove in said trough such that said insert lies flush against said trough with substantially unimpeded liquid flow caused by such fit.

20. In the separator of claim 13 wherein said surface irregularities are in the form of spaced generally parallel areas studded with abrasive materials to change the flow characteristics of said separator.

* * * * *